US005695113A

United States Patent [19]

Rau et al.

[11] Patent Number: 5,695,113

[45] Date of Patent: Dec. 9, 1997

[54] MAIL INDICATOR

[76] Inventors: Nelson E. Rau; Keith P. Rau, both of 20078 Woodworth, Redford, Mich. 48240

[21] Appl. No.: 606,795

[22] Filed: Feb. 27, 1996

[51] Int. Cl.[6] ..... B65D 91/00

[52] U.S. Cl. ..... 232/34; 232/17; 362/276; 362/802

[58] Field of Search ..... 232/34, 35, 17; 362/276, 802

[56] References Cited

U.S. PATENT DOCUMENTS

| | | | |
|---|---|---|---|
| 3,556,394 | 1/1971 | Caldes | 232/36 |
| 4,449,663 | 5/1984 | Schluter | 232/35 |
| 4,473,182 | 9/1984 | Dion | 232/35 |
| 4,651,135 | 3/1987 | Duhaime et al. | 232/34 X |
| 5,125,570 | 6/1992 | Jones | 232/34 |
| 5,255,843 | 10/1993 | Deakyne | 232/35 |
| 5,335,848 | 8/1994 | Schreiber | 232/34 |
| 5,377,906 | 1/1995 | Mason | 232/34 |
| 5,504,662 | 4/1996 | Huang | 363/276 X |

*Primary Examiner*—Blair Johnson
*Attorney, Agent, or Firm*—Joseph N. Breaux

[57] ABSTRACT

A mail indicator including a weight reactive mechanism that is positionable within a conventional rural mail box and that includes a weight receiving plate that is mechanically linked to a pair of electrical contacts in a manner such that the electrical contacts change contact state when a weight of greater than one-quarter (¼ Oz.) ounce is supported by the weight receiving plate; an electrically powered light emitting device wired in series with the pair of electrical contacts; and a power source connection bracket having a first and second terminal, the first and second terminals being connected in series with the pair of electrical contacts.

8 Claims, 2 Drawing Sheets

MAIL INDICATOR

TECHNICAL FIELD

The present invention relates to devices for providing an indication that mail has been introduced into an empty mail box and more particularly to devices for providing an indication that mail has been introduced into an empty mail box that provide a visual indication via a light emitting device.

BACKGROUND ART

Mail is generally delivered to a box positioned adjacent the home or street of the person receiving the mail. Checking the box for the arrival of the mail can be troublesome for those individuals having a box positioned adjacent the street. This can be particularly troublesome during inclimate weather and for those suffering from various disabilities. It would be a benefit, therefore, to have a device that would provide a visual indication that is readily visible from a distance that signaled the arrival of the mail. It would be a further benefit if the device was readily installed in an existing mail box.

GENERAL SUMMARY DISCUSSION OF INVENTION

It is thus an object of the invention to provide a mail indicator that device that provides a visual indication that is readily visible from a distance that signals the arrival of the mail.

It is a further object of the invention to provide a mail indicator that is readily installed in an existing mail box.

It is a still further object of the invention to provide a mail indicator that includes a weight reactive mail detection mechanism that is disposed within the mail box during installation.

It is a still further object of the invention to provide a mail indicator that accomplishes all or some of the above objects in combination.

Accordingly, a mail indicator device is provided. The mail indicator includes a weight reactive mechanism that is positionable within a conventional rural mail box and that includes a weight receiving plate that is mechanically linked to a pair of electrical contacts in a manner such that the electrical contacts change contact state when a weight of greater than one-quarter (¼ Oz.) ounce is supported by the weight receiving plate; an electrically powered light emitting device wired in series with the pair of electrical contacts; and a power source connection bracket having a first and second terminal, the first and second terminals being connected in series with the pair of electrical contacts.

The weight receiving plate preferably includes a base member positionable on the bottom of an existing mail box and hingedly connected to the weight receiving plate in a manner to allow the weight receiving plate to pivot between a first position in which the weight receiving plate forces the pair of contacts into electrical contact and a second position in which the weight receiving plate forces the pair of contacts out of electrical contact.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
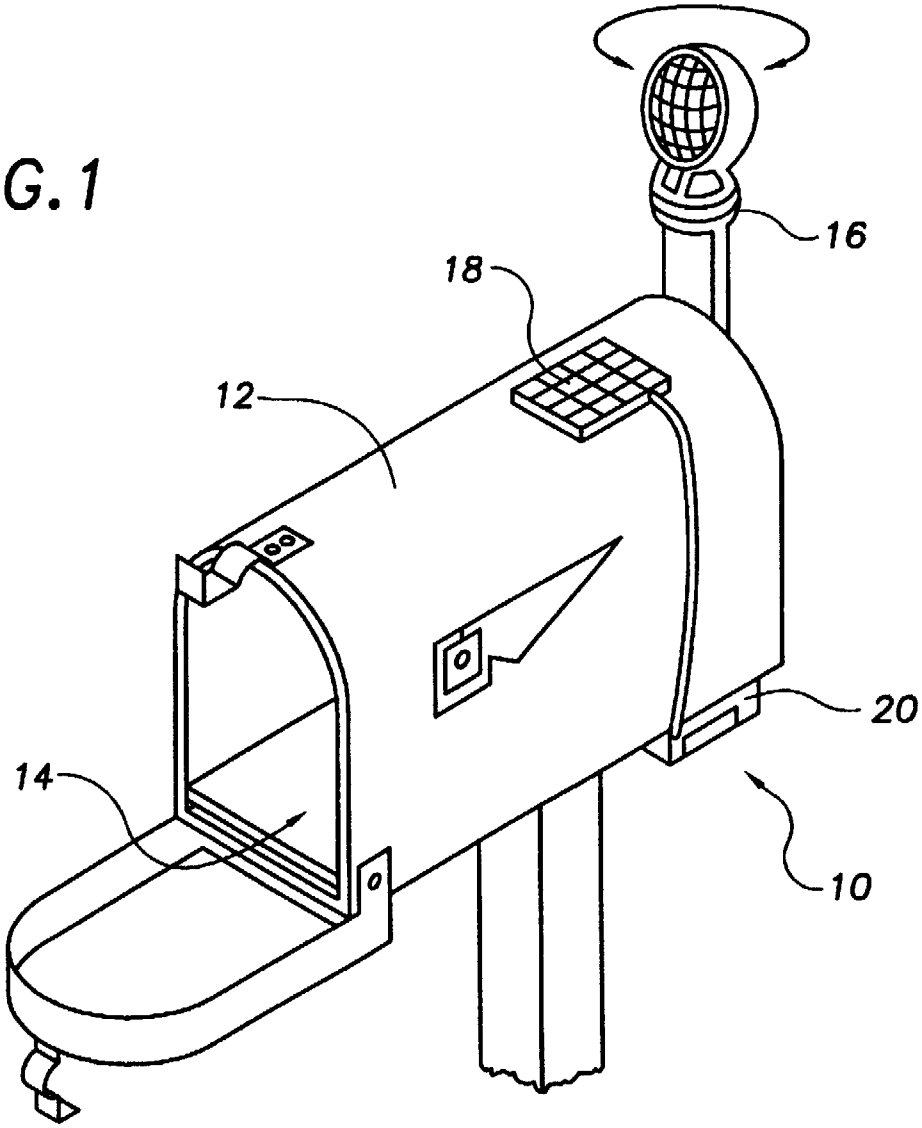
FIG. 1 is a perspective view of an exemplary embodiment of the mail indicator of the present invention installed within a representative rural type mail box showing the light emitting device, the weight receiving plate the battery storage compartment and a solar cell array.
Figure 2:
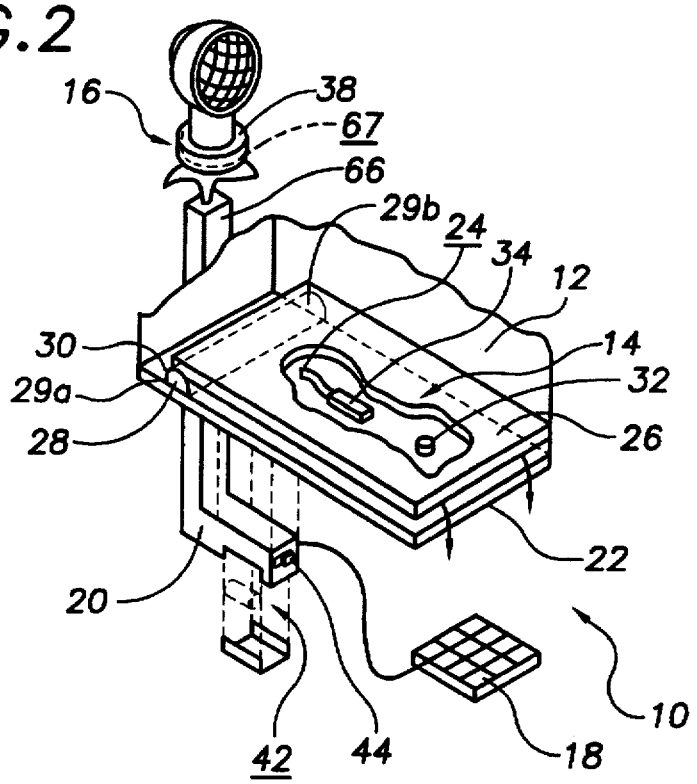
FIG. 2 is a cutaway perspective view showing the pair of electrical contacts, the weight receiving plate pivotally connected to a base member and supported above the bottom of the representative mail box by the biasing spring, the battery exploded out from the battery compartment, and the light bulb housing of the light emitting device exploded away from the far end of the L-shaped battery housing.

FIG. 1 shows an exemplary embodiment of the mail indicator of the present invention, generally designated by the numeral 10, installed within a representative rural type mail box 12. Mail indicator 10 includes a weight reactive mechanism, generally designated by the numeral 14; a light emitting device 16, a solar cell array 18, and a battery housing 20. With reference to FIG. 2, mail box 12 includes a substantially planar bottom surface 22 having about a three-eighths (⅜") inch wiring aperture 24 formed therethrough during installation of mail indicator 10. In this embodiment, weight reactive mechanism 14 includes a weight receiving plate 26; a base member 28 having two connecting arm projections **29*a*, 29*b*, each connecting arm 29*a*, 29*b* being pivotally connected to weight receiving plate 26 by a hinge 30; a biasing spring 32; and a pair of normally open electrical contacts 34. Biasing spring 32 and electrical contacts 34 are both positioned between bottom surface 22 and weight receiving plate 26. Biasing spring 32 is of a length and has a spring constant sufficient to just exert enough force between bottom surface 22 and weight receiving plate 26 to maintain weight receiving plate 26 above bottom surface 22 a distance sufficient to allow contact pair 34 to just maintain an electrically open circuit configuration. The spring constant of biasing spring 32 is selected such that placement of a weight of no more than one-quarter (¼ Oz.) ounce upon weight receiving plate 26 is sufficient to cause weight receiving plate 26 to move toward bottom surface 22 a distance sufficient to cause electrical contact pair 34** to change states from an electrically open circuit to an electrically closed circuit.

Also shown in FIG. 2 is solar cell array 18. Solar cell array 18 functions as a second power source for a conventional light bulb housed within a light bulb housing 38. In this embodiment battery housing 20 is plastic, L-shaped and includes a battery compartment 42, and a transfer switch 44. Transfer switch 44 is utilized to allow the user to select either the battery housed in battery compartment 42 or solar cell array 18 as the source of power for the light bulb housed within light bulb housing 38 of light emitting device 16. Light bulb housing 38 has a battery housing receiving cavity 67 formed therein into which a far end 66 of L-shaped battery housing 20 is frictionally fit in a manner such that light bulb housing 38 is rotatable with respect to L-shaped battery housing 20 and held in a desired position with respect thereto by friction.

Figure 3:
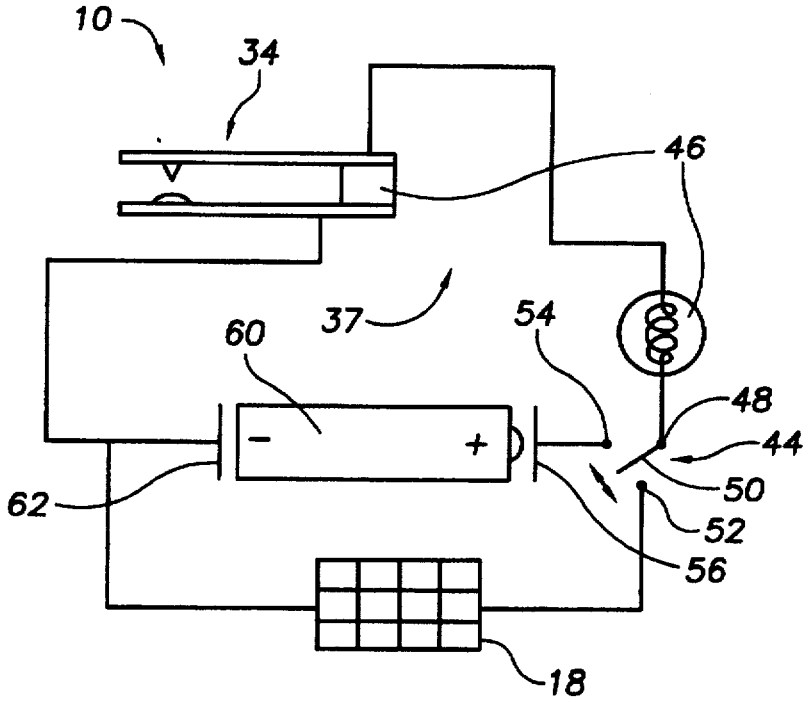
FIG. 3 is a schematic representation of the electrical circuit of the exemplary mail indicator of FIG. 1.

FIG. 3 shows a schematic representative of the electrical circuit 37 utilized in mail. indicator 10. As shown in the figure, contact pair 34 is a normally open type contact pair. Contact pair 34 is wired in series with a light bulb 46 and one pole 48 of transfer switch 44. Transfer switch 44 includes a throw 50 that is moveable between a first throw position in contact with a second pole 52 that is wired to a positive terminal of solar cell array 18 and a second throw position in contact with a third pole 54 that is wired to a positive battery bracket contact 56. It can be seen that when throw 50 is in the first throw position light bulb 46 is powered by solar cell array 18 and when throw 50 is in the second throw position light bulb 46 is powered by a battery 60 positioned between positive battery bracket contact 56 and a negative battery bracket contact 62.

Installation of mail indicator 10 into a rural type mailbox 12 is now described with general reference to FIGS. 1–3. A wiring aperture 24 is drilled or otherwise provided through bottom surface 22 of mail box 12. Wiring aperture 24 is dimensioned to allow insertion therethrough of electrical contacts 34. Electrical contacts 34 are inserted through wiring aperture 24 and adhesively secured to bottom surface 22. Weight reactive mechanism 14 is then inserted into the mail compartment of mail box 12 with base member 28 in contact with bottom surface 22 at the back of the mail compartment. Biasing spring 32 is then inserted between weight receiving plate 26 and bottom surface 22.

Once weight reactive mechanism 14 is in place, L-shaped battery housing 20 is adhesively secured in place along the bottom and side of mail box 12 in a manner such that light bulb housing 38 extends upwardly past the top of mail box 12. Light bulb housing 38 is then swivelled into a desired position to provide an optimal light signal in the required direction. Signal operation of mail indicator occurs automatically when an envelope of other mail having a weight exceeding one-quarter ounce is placed upon weight receiving member 26. The weight of the mail piece causes weight receiving plate 26 to move toward bottom surface 22. When weight receiving member 26 moves to the second position, contacts 34 close completing the circuit between the power source and light bulb 46. Removal of the mail allows biasing spring 32 to force weight receiving plate 16 away from bottom surface 22 a distance sufficient to allow contacts 34 to open—breaking the circuit between the power source and light bulb 46. The term power source is used herein to indicate either the solar cell array 18 or a battery 60 installed between battery contacts 56, 60.

It can be seen from the preceding description that a mail indicator has been provided that provides a readily visible, visual indication that mail has been placed within a mail box; that is readily installed in an existing mail box; and that includes a weight reactive mail detection mechanism that is disposed within the mail box during installation.

It is noted that the embodiment of the mail indicator described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A mail indicator comprising:

a weight reactive mechanism that is positionable within a conventional rural mail box and that has a weight receiving plate that is mechanically linked to a pair of electrical contacts in a manner such that said electrical contacts change contact state when a weight of greater than one-quarter ounce is supported by said weight receiving plate;

an electrically powered light emitting device wired in series with said pair of electrical contacts and including a light bulb housing having a battery housing receiving cavity formed therein;

a power source connection bracket having a first and second terminal, said first and second terminals being connected in series with said pair of electrical contacts; and an L-shaped battery housing including a battery compartment formed therein, said L-shaped battery housing having an upper end thereof in rotating connection with said battery housing receiving cavity of said light bulb housing of said light emitting device in a manner such that said light emitting device is rotatable with respect to said L-shaped battery housing and held in a desired position by friction between said upper end of said L-shaped battery housing and said battery housing of said light emitting device;

said weight reactive mechanism further including a base member and a biasing spring, said base member having two connecting arm projections, each connecting arm projection being pivotally connected to said weight receiving plate, said biasing spring being secured to a surface of said weight receiving plate.

2. The mail indicator of claim 1 wherein:

said biasing spring is of a length and has a spring constant sufficient to just exert enough force between a bottom surface and said weight receiving plate to maintain said weight receiving plate above said bottom surface.

3. The mail indicator of claim 1 further comprising:

a solar cell array connectable in series with said light emitting device by operation of a switch mechanism.

4. The mail indicator of claim 3 wherein:

said biasing spring is of a length and has a spring constant sufficient to just exert enough force between a bottom surface and said weight receiving plate to maintain said weight receiving plate above said bottom surface.

5. The mail indicator of claim 3 further comprising:

a solar cell array connectable in series with said light emitting device by operation of a switch mechanism.

6. The mail indicator of claim 5 wherein:

said biasing spring is of a length and has a spring constant sufficient to just exert enough force between a bottom surface and said weight receiving plate to maintain said weight receiving plate above said bottom surface.

7. A mail indicator comprising:

a weight reactive mechanism that is positionable within conventional rural mail box and that has a weight receiving plate that is mechanically linked to a pair of electrical contacts in a manner such that said electrical contacts change contact state when a weight of greater than one-quarter ounce is supported by said weight receiving plate;

an electrically powered light emitting device wired in series with said pair of electrical contacts and including a light bulb housing having a battery housing receiving cavity formed therein;

a power source connection bracket having a first and second terminal, said first and second terminals being connected in series with said pair of electrical contacts; and an L-shaped battery housing including a battery compartment formed therein, said L-shaped battery housing having an upper end thereof in rotating connection with said said battery housing receiving cavity of said light bulb housing of said light emitting device in a manner such that said light emitting device is rotatable with respect to said L-shaped battery housing and held in a desired position by friction between said upper end of said L-shaped battery housing and said battery housing of said light emitting device;

said weight receiving plate including a base member positionable on a bottom of said existing mail box that is hingedly connected to said weight receiving plate in a manner to allow said weight receiving plate to pivot between a first position in which said weight receiving plate forces said pair of contacts into electrical contact and a second position in which said weight receiving plate forces said pair of contacts out of electrical contact when said base member is positioned on said bottom of said existing mail box; and said weight reactive mechanism further including a base member and a biasing spring, said base member having two connecting arm projections, each said connecting arm projection being pivotally connected to said weight receiving plate, said biasing spring being secured to a surface of said weight receiving plate, said biasing spring being of a length and having a spring constant sufficient to just exert enough force between said bottom surface and said weight receiving plate to maintain said weight receiving plate above said bottom surface.

8. The mail indicator of claim 7 further comprising:

a solar cell array connectable in series with said light emitting device by operation of a switch mechanism.

* * * * *